US008550594B2

(12) United States Patent
Murahashi et al.

(10) Patent No.: US 8,550,594 B2
(45) Date of Patent: Oct. 8, 2013

(54) IMAGE FORMING APPARATUS

(75) Inventors: Kenichi Murahashi, Kitakyushu (JP); Kazuya Yoshikaie, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 70 days.

(21) Appl. No.: 13/218,249

(22) Filed: Aug. 25, 2011

(65) Prior Publication Data

US 2012/0050355 A1 Mar. 1, 2012

(30) Foreign Application Priority Data

Aug. 27, 2010 (JP) ..... 2010-191244

(51) Int. Cl.
*B41J 23/00* (2006.01)
*B41J 2/195* (2006.01)

(52) U.S. Cl.
USPC ..... 347/37; 347/7; 347/39

(58) Field of Classification Search
None
See application file for complete search history.

(56) References Cited

U.S. PATENT DOCUMENTS 6,951,382 B2 10/2005 Inui et al.
2007/0291077 A1 * 12/2007 Seki et al. ..... 347/37

FOREIGN PATENT DOCUMENTS

JP 2004-001411 A 1/2004

* cited by examiner

*Primary Examiner* — Geoffrey Mruk
(74) *Attorney, Agent, or Firm* — Kilpatrick Townsend & Stockton LLP

(57) ABSTRACT

An image forming apparatus that forms an image on a medium by discharging liquid from a discharge head, wherein a carriage on which the discharge head is mounted is made to be able to reciprocate, and in a case where agitation of liquid is required, control is performed such that operation areas of a plurality of places set within a movable range of the carriage are changed over and the carriage then reciprocates within the operation area.

18 Claims, 9 Drawing Sheets

IMAGE FORMING APPARATUS

BACKGROUND

1. Technical Field

The present invention relates to an image forming apparatus which forms an image on a medium by discharging liquid from a discharge head.

2. Related Art

In the past, as this type of image forming apparatus, an image forming apparatus has been proposed in which the ink in the discharge head or a tank which is mounted on a carriage is agitated by reciprocating the carriage in a main scanning direction (refer to JP-A-2004-1411, for example). Since pigment ink is ink in which pigment particles are dispersed in a solvent, if it is neglected over a long period of time, the pigment particles settle, so that the concentration of pigment becomes non-uniform in an upper portion and a lower portion of the tank. For this reason, a configuration is made such that the concentration of ink can be uniformized by reciprocating (blank scan) the carriage in the main scanning direction without discharge of ink from a recording head.

Usually, the carriage has a carriage belt attached thereto and is also slidably mounted on a carriage guide disposed along in the main scanning direction, and the carriage is reciprocated while being guided by the carriage guide by driving the carriage belt by a carriage motor. At this time, in order to perform agitation of ink in a short time as much as possible, it is desirable to make the speed of reciprocation of the carriage faster than that at a normal time (the time of image formation) or narrow the width of the reciprocation. However, in some cases, there is concern that a load may be concentrated on the specific portion of the carriage belt or the carriage guide. On the other hand, it is also considered to increase the rigidity of the carriage belt or the carriage guide. However, weight increases or an increase in size is caused.

SUMMARY

An advantage of some aspects of the invention is that it provides an image forming apparatus in which agitation of liquid is performed by reciprocation of a carriage while reducing a load on a carriage belt, a carriage guide, or the like.

An image forming apparatus according to an aspect of the invention adopts the following measures in order to achieve the above-mentioned advantage.

According to a first aspect of the invention, there is provided an image forming apparatus that forms an image on a medium by discharging liquid from a discharge head, the apparatus including: a carriage on which the discharge head is mounted; a driving section which reciprocates the carriage; and an agitation control section which controls, in a case where agitation of the liquid is required, the driving section such that operation areas of a plurality of places set within a movable range of the carriage are changed over and the carriage then reciprocates within the operation areas.

In the image forming apparatus according to the above aspect of the invention, in a case where agitation of the liquid is required, the driving section which moves the carriage is controlled such that the operation areas of a plurality of places set within the movable range of the carriage are changed over and the carriage then reciprocates within the operation areas. In this way, it is possible to disperse a load on a carriage guide, a carriage belt, or the like, so that it is possible to perform agitation of liquid by reciprocation of the carriage while reducing the load on these.

In the image forming apparatus according to the above aspect of the invention, the operation areas of a plurality of places may be set such that reverse positions when reciprocating the carriage do not overlap each other. This is based on the fact that a load which acts on the carriage guide, the carriage belt, or the like becomes large when the carriage performs reverse movement. In the image forming apparatus according to the above aspect of the invention, the agitation control section may also control the driving section such that in a single reciprocating operation of the carriage, a moving distance at the time of forward movement becomes longer than a moving distance at the time of return movement. Further, the agitation control section may also control the driving section so as to gradually change the operation area while the carriage reciprocates.

Further, in the image forming apparatus according to the above aspect of the invention, the operation areas of a plurality of places may be set such that the reciprocating ranges of the carriage do not overlap each other. In this way, it is possible to more reliably disperse a load which acts on the carriage guide, the carriage belt, or the like.

Further, in the image forming apparatus according to the above aspect of the invention, the operation areas of a plurality of places may be set in ranges different from a range in which liquid is discharged onto a medium of a given size, within the movable range of the carriage. Because a load which acts on the carriage guide, the carriage belt, or the like at the time of image formation is also taken into account, it is possible to further disperse a load.

Further, in the image forming apparatus according to the above aspect of the invention, as the operation areas of a plurality of places, a first operation area and a second operation area may be respectively set on one end side and the other end side of the movable range of the carriage, the second operation area may be an area which includes a flushing area that receives liquid discharged from the discharge head at the time of a flushing operation, and the agitation control section may be a section which selects the first operation area in the case of reciprocating the carriage without a flushing operation of the discharge head and selects the second operation area in the case of reciprocating the carriage with the flushing operation of the discharge head. In this way, it is possible to smoothly perform the flushing operation while agitating the liquid and also it is possible to disperse a load which acts on the carriage guide, the carriage belt, or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
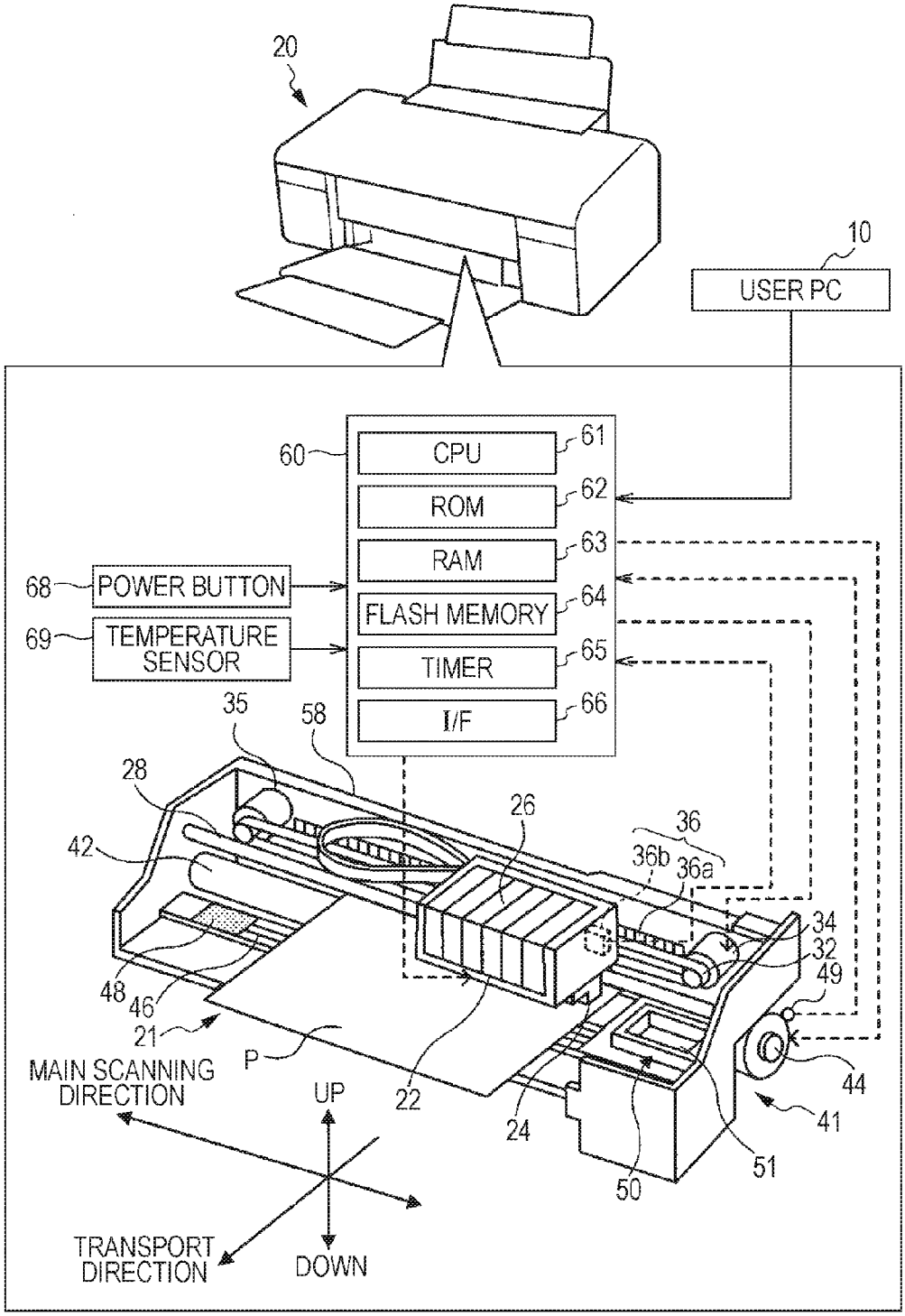
FIG. 1 is a configuration diagram illustrating the outline of the configuration of an ink jet printer of an embodiment.
Figure 2:
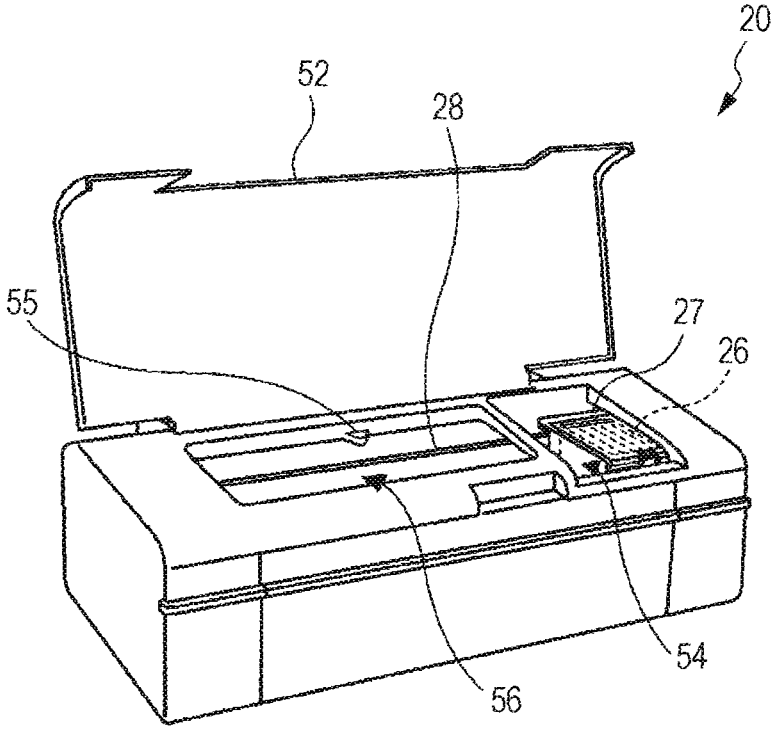
FIG. 2 is an exterior diagram illustrating an appearance in a state where a printer cover has been opened.

Next, embodiments of the invention will be described on the basis of the drawings. FIG. 1 is a configuration diagram illustrating the outline of the configuration of an ink jet printer 20 as one embodiment of the invention, and FIG. 2 is an exterior diagram illustrating the appearance of the ink jet printer 20 in a state where a printer cover 52 has been opened.

The ink jet printer 20 of this embodiment includes a paper feed mechanism 41 which transports paper P in a sub-scanning direction (a direction from the back to the front of the drawing), a printer mechanism 21 which performs printing by discharging ink droplets from nozzles formed in a printing head 24 with movement in a main scanning direction (a left-and-right direction in the drawing) with respect to the paper P transported onto a platen 46 by the paper feed mechanism 41, and a controller 60 which controls the whole apparatus, as shown in FIG. 1. At one end (the right end in FIG. 1) in the main scanning direction of the platen 46, a capping device 50 which seals the nozzle plane of the printing head 24 is provided, and at the other end (the left end in FIG. 1) in the main scanning direction of the platen 46, a flushing area 48 for performing flushing which discharges ink droplets from the nozzles of the printing head 24 on a regular basis in order to prevent clogging of the nozzle is provided.

The printer mechanism 21 includes a carriage 22 capable of reciprocating in the main scanning direction while being guided by a carriage guide 28, a carriage motor 34 and a driven roller 35 which are respectively installed on one end side and the other end side of the carriage guide 28, a carriage belt 32 which is spanned across the carriage motor 34 and the driven roller 35 and also attached to the carriage 22, an ink cartridge 26 which is mounted on the carriage 22, stores ink of each color of cyan (C), light cyan (LC), magenta (M), light magenta (LM), yellow (Y), and black (K), in which pigment particles are dispersed in water as a solvent, and can be replaced independently for each color, and the printing head 24 in which a plurality of nozzles that discharge ink droplets by pressurizing each ink supplied from the ink cartridge 26 is formed, as shown in FIG. 1. The carriage 22 is made so as to be reciprocated in the main scanning direction by driving the carriage belt 32 by the carriage motor 34. In addition, a carriage position sensor 36 which detects the position in the main scanning direction of the carriage 22 is mounted on the back surface side of the carriage 22. The carriage position sensor 36 is constituted by a linear type optical scale 36*a* disposed on a frame 58 along the carriage guide 28 and an optical sensor 36*b* which is mounted on the back surface of the carriage 22 so as to face the optical scale 36*a* and optically reads the optical scale 36*a*.

The paper feed mechanism 41 includes a transport roller 42 which transports the paper P onto the platen 46 and a transport motor 44 which rotationally drives the transport roller 42, as shown in FIG. 1. On a rotary shaft of the transport motor 44, a rotary encoder 49 which detects a rotational amount is mounted, and the driving of the transport motor 44 is controlled on the basis of the rotational amount from the rotary encoder 49. In addition, although it is not shown in the drawing, the rotary encoder 49 is constituted by a rotary scale marked with a scale at predetermined rotational angle intervals, and a rotary scale sensor for reading the scale of the rotary scale.

The capping device 50 prevents drying of ink in the nozzles by sealing the nozzle plane in a state where the printing head 24 has been moved to a position (a so-called home position) facing the capping device 50 or cleans the printing head 24 by suctioning ink in the nozzles in a state where the nozzle plane has been sealed. The capping device 50 includes, in addition to a cap 51 of an approximately rectangular parallelepiped shape opened upward in order to hermetically seal the nozzle plane of the printing head 24, a tube (not shown) connected to the bottom of the cap 51, a suction pump (not shown) attached to the tube, or the like. In the case of cleaning the printing head 24, the capping device 50 forcibly suctions ink in the nozzles by making an internal space which is formed by the nozzle plane of the printing head 24 and the cap 51*a* negative pressure by driving the suction pump in a state where the nozzle plane of the printing head 24 has been sealed by the cap 51.

The controller 60 is constituted as a microprocessor centering on a CPU 61 and includes a ROM 62 in which a processing program is stored, a RAM 63 in which data is temporarily stored, a flash memory 64 which is rewritable and in which data is held even if the power is turned off, a timer 65, and an interface (I/F) 66. The position of the carriage 22 from the carriage position sensor 36, the rotational amount of the transport roller 42 from the rotary encoder 49, a power-on signal from a power button 68, an ambient temperature from a temperature sensor 69 which detects the ambient temperature of the ink jet printer 20, and the like are input to the controller 60 through the I/F 66, and a driving signal to the printing head 24, a driving signal to the transport motor 44, a driving signal to the carriage motor 34, a driving signal to the suction pump, and the like are output from the controller 60 through the I/F 66. Further, the controller 60 receives printing instructions or printing data from a user PC 10 through the I/F 66. In addition, a print buffer area is provided in the RAM 63, and if the printing data is received from the user PC 10, the received printing data is stored in the print buffer area.

In the ink jet printer 20 of this embodiment, as shown in FIG. 2, in the top surface in a state where the printer cover 52 has been opened, an opening portion for cartridge replacement 54 for performing mounting or replacement of the ink cartridge 26 at this position and an opening portion for replacement cartridge confirmation 56 for confirming a state where the ink cartridge 26 needed to be replaced moves up to the position of a mark 55 by a button operation from a user are formed. In this embodiment, the opening portion for replacement cartridge confirmation 56 is formed in a wide width, and a state where the printing head 24 (the carriage 22) reciprocates between one end side (the home position) and the other end side can also be confirmed from the opening portion for cartridge replacement 54 or the opening portion for replacement cartridge confirmation 56.

Figure 3:
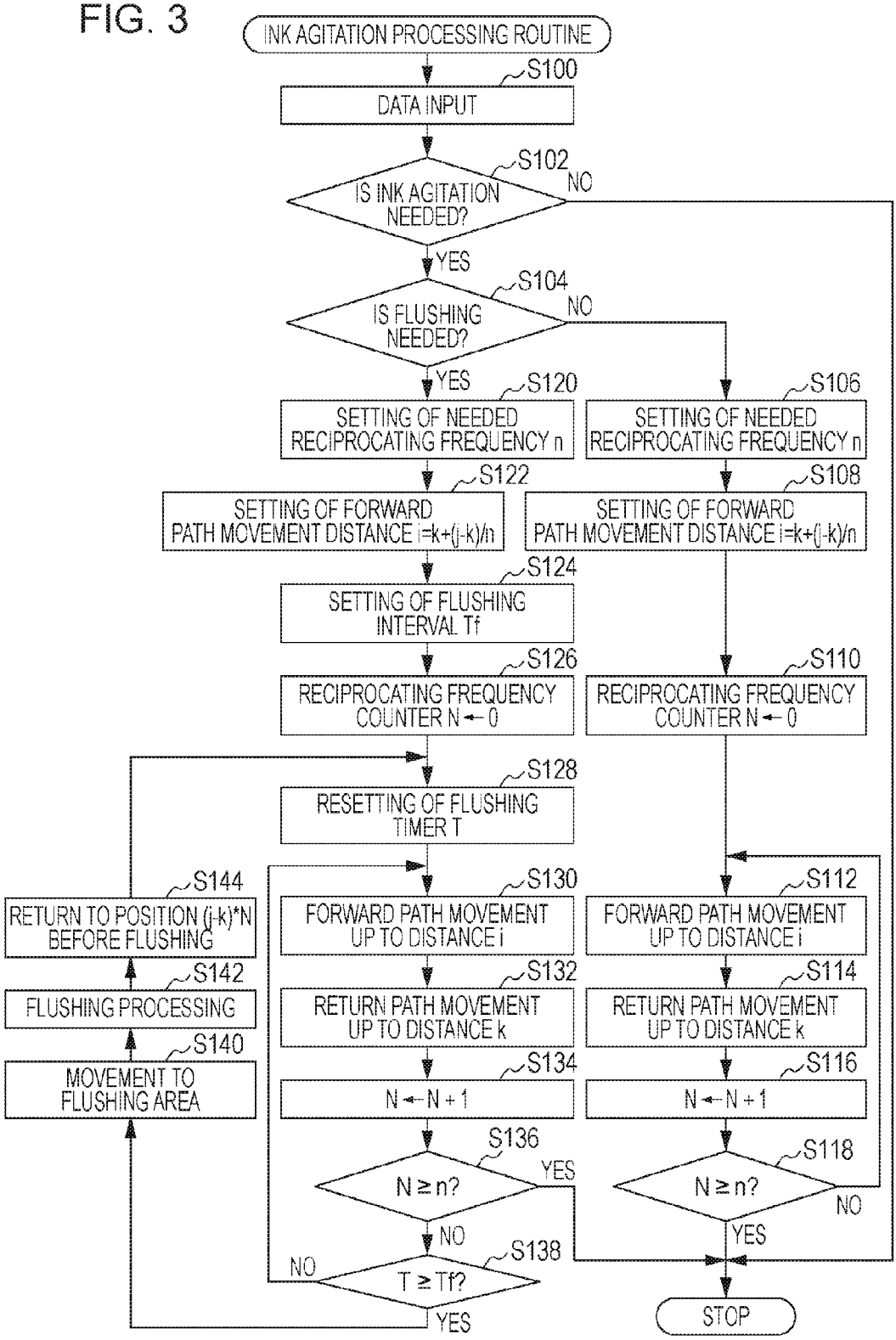
FIG. 3 is a flowchart illustrating one example of an ink agitation processing routine of the embodiment.
Figure 4A:
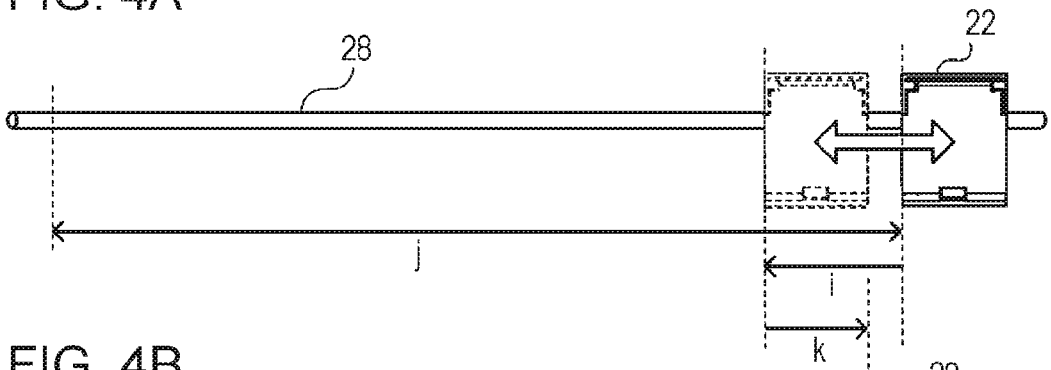
FIGS. 4A to 4D are explanatory diagrams illustrating the states of ink agitation.
Figure 4B:
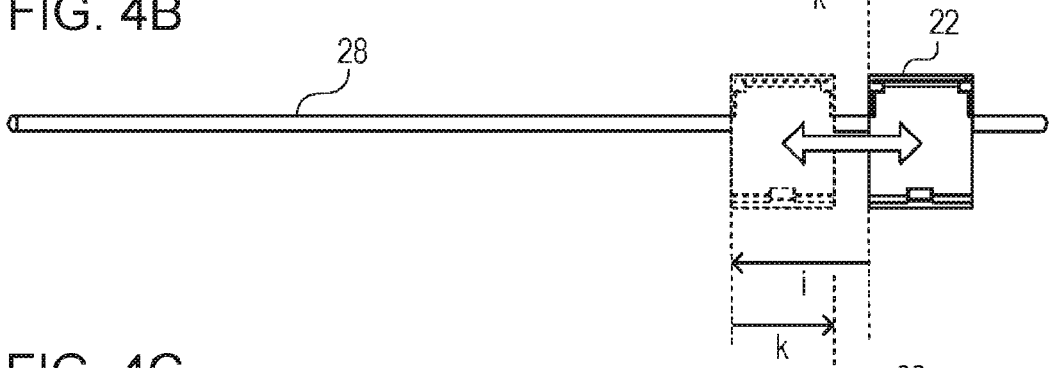
Figure 4C:
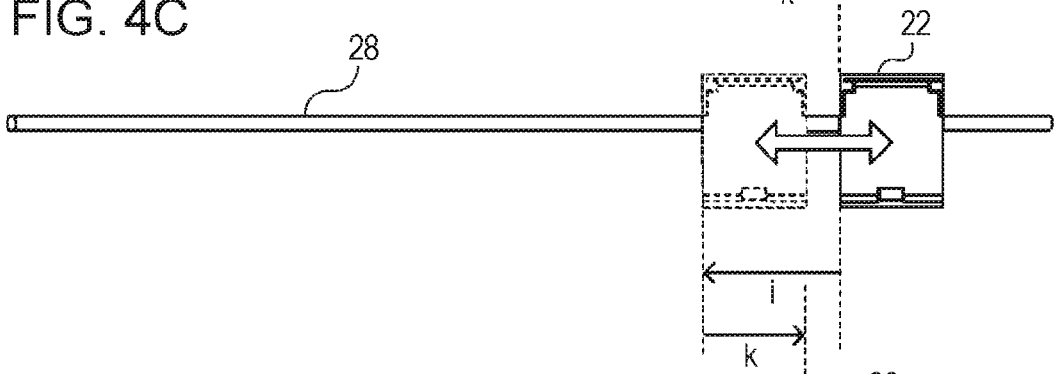
Figure 4D:
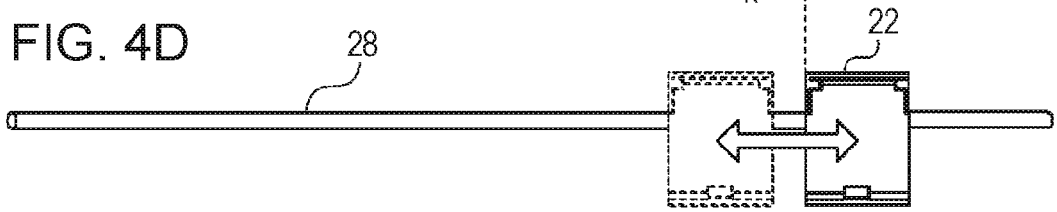

Next, an operation of the ink jet printer 20 of this embodiment configured in this manner, especially, an operation for agitating ink in the ink cartridge 26 to make the concentration of ink uniform will be described. FIG. 3 is a flowchart showing one example of an ink agitation processing routine which is executed by the CPU 61 of the controller 60. This routine is repeatedly executed every predetermined time. In this embodiment, since pigment ink is used as ink and pigment in a solvent tends to settle, by reciprocating the carriage 22 with the ink cartridge 26 mounted thereon without discharging ink from the printing head 24, pigment in the ink cartridge 26 is agitated, thereby uniformizing the concentration thereof.

If the ink agitation processing routine is executed, the CPU 61 of the controller 60 first inputs data needed for processing (Step S100) and determines whether or not agitation of ink is needed on the basis of the input data (Step S102). In this embodiment, immediately after power-on, when an elapsed time from power-on is a predetermined time or more, when the ink cartridge 26 has been newly mounted, or when the ink cartridge 26 has been replaced, a decision that agitation of ink is needed is made. In a case where it is determined that agitation of ink is not needed, this routine ends with doing nothing.

On the other hand, if it is determined that agitation of ink is needed, it is determined whether or not flushing is needed when reciprocating the printing head 24 in order to agitate the ink (S104). In this embodiment, in a case where the ink cartridge 26 is newly mounted and initial filling is needed and a case where the ink cartridge 26 is replaced and cleaning of the printing head 24 is needed, since clogging of the nozzle is solved by the initial filling or the cleaning, a decision that flushing is not needed is made.

In a case where it is determined that flushing is not needed, a needed reciprocating frequency n that is the number of times of reciprocation of the carriage 22 which is needed until agitation of ink is completed is set (Step S106). Since the case where it is determined that flushing is not needed is either a case where the ink cartridge 26 has been newly mounted or a case where the ink cartridge 26 has been replaced and there is a possibility that the ink cartridge 26 might have been neglected over a long period of time, the relatively large number of times (for example, 250 times, 270 times, 300 times, or the like) is set as the needed reciprocating frequency n. In addition, for example, if an IC chip with a production date recorded therein is attached to the ink cartridge 26, the needed reciprocating frequency n may also be set on the basis of a neglected time calculated by reading the production date, thereby calculating a neglected time. Further, since there is a case where the progress state of settling of pigment differs depending on the color of ink, the needed reciprocating frequency n which differs for each color of the replaced ink cartridge may also be set. If the needed reciprocating frequency n is set, a movement distance i in a forward path when the carriage 22 reciprocates is calculated by the following Expression (1) on the basis of the set needed reciprocating frequency n (Step S108). Here, "k" in Expression (1) expresses a movement distance in a return path, and "j" expresses a movable distance of the carriage 22 from one end side (the home position side) in the main scanning direction to the other end side (the flushing area 48 side). Subsequently, a reciprocating frequency counter N is initialized to the value 0 (Step S110), the driving of the carriage motor 34 is controlled such that the carriage 22 moves in the forward path from the present value up to the distance i (Step S112), and the driving of the carriage motor 34 is controlled such that after the carriage 22 has moved in the forward path, the carriage 22 reverses and moves in the return path up to the distance k (Step S114). Then, the reciprocating frequency counter N is incremented by the value 1 (Step S116) and it is determined whether or not the reciprocating frequency counter N has reached the needed reciprocating frequency n (Step S118). In a case where the reciprocating frequency counter N has not reached the needed reciprocating frequency n, the routine returns to Step S112 and the processes of Steps S112 to S116 are then repeated in which the forward path movement and the return path movement of the carriage 22 are performed and also the reciprocating frequency counter N is incremented by the value 1, and in a case where the reciprocating frequency counter N has reached the needed reciprocating frequency n, this routine is ended here. In FIGS. 4A to 4D, the states of ink agitation by movement of the carriage 22 are shown. Agitation of ink is performed by repeating an operation in which the carriage 22 advances by the distance i at the time of the forward path movement and returns by the distance k at the time of the return path movement, as shown in the drawing. Therefore, the reciprocating range of the carriage 22 is shifted in a direction away from the start position by a distance (i−k) in which the return movement distance k is subtracted from the forward movement distance i per single reciprocation. This is for preventing a load from being concentrated on one place of the carriage guide 28 or the carriage belt 32. Here, the carriage guide 28 or the carriage belt 32 is not uniformly worn in the reciprocating section of the carriage 22 and a load most acts thereon when the carriage 22 reverses from the forward movement to the return movement or from return movement to the forward movement. In this embodiment, the moving range of a single reciprocation of the carriage 22 partially overlaps in the previous time and the next time. However, the relationship between the movement distance i in the forward path and the movement distance k in the return path is determined such that the reverse position from the forward movement to the return movement of the previous time and the reverse position from the return movement to the forward movement of the next time do not overlap each other. For this reason, according to the needed reciprocating frequency n, a need to change the value of "j" of Expression (1) occurs. Since the movement distance i in the forward path is calculated by Expression (1), if the forward path movement of the distance i and the return path movement of the distance k are repeated over the needed reciprocating frequency n, the carriage 22 moves from the start position on the home position side up to the position of the distance j, in this embodiment, the flushing area 48 side of the end on the opposite side to the home position.

$$i=k+(j-k)/n \tag{1}$$

On the other hand, in a case where it is determined that flushing is needed, the needed reciprocating frequency n is set (Step S120) and the forward path movement distance i is calculated by the above-mentioned Expression (1) on the basis of the set needed reciprocating frequency n (Step S122). Here, since the case where it is determined that flushing is needed is either immediately after power-on or a case where an elapsed time from power-on is the predetermined time or more and the neglected period of the ink cartridge 26 is considered to be short compared to a case where the ink cartridge 26 has been newly mounted or a case where the ink cartridge 26 has been replaced, the relatively small number of times (for example, 60 times, 70 times, 80 times, or the like) is set as the needed reciprocating frequency n. Subsequently, a flushing interval Tf is set on the basis of an ambient temperature among data input in Step S100 (Step S124). Here, in this embodiment, in a case where the ambient temperature from the temperature sensor 69 is equal to or more than a predetermined temperature (for example, 35° C. or the like), the flushing interval Tf is set to be a relatively short interval (for example, 5 seconds, 6 seconds, 7 seconds, or the like), and in a case where the ambient temperature is less than the predetermined temperature, the flushing interval Tf is set to be a relatively long interval (for example, 10 seconds, 12 seconds, 15 seconds, or the like). This is based on the fact that the higher the ambient temperature, the more the risk of thickening of ink and the probability of clogging of the nozzle increase. Then, the reciprocating frequency counter N is initialized to the value 0 (Step S126) and also a flushing timer T is reset (Step S128), the driving of the carriage motor 34 is controlled such that the carriage 22 moves in the forward path from the present value up to the distance i (Step S130), and the driving of the carriage motor 34 is controlled such that after the carriage 22 has moved in the forward path, the carriage 22 reverses and moves in the return path up to the distance k (Step S132). If the carriage 22 reciprocates once, the reciprocating frequency counter N is incremented by the value 1 (Step S134), and it is determined whether or not the reciprocating frequency counter N has reached the needed reciprocating frequency n (Step S136) and whether or not the flushing timer T has reached the flushing interval Tf (Step S138). In a case where the reciprocating frequency counter N has not reached the needed reciprocating frequency n and the flushing timer T has not reached the flushing interval Tf, the routine returns to Step S130 and the processes of Steps S130 to S136 are then repeated in which the forward path movement and the return path movement of the carriage 22 are performed and also the reciprocating frequency counter N is incremented by the value 1. On the other hand, in a case where although the reciprocating frequency counter N has not reached the needed reciprocating frequency n, the flushing timer T reaches the flushing interval Tf, the driving of the carriage motor 34 is controlled such that the carriage 22 moves to the flushing area 48 (Step S140), the flushing processing of discharging ink droplets from all the nozzles of the printing head 24 toward the flushing area 48 is executed (Step S142), and thereafter, a position Pc of the carriage 22 before the flushing processing is calculated by the following Expression (2) and the carriage 22 is moved to the position Pc (Step S144), the routine returns to Step S130, and the processes of Steps S130 to S136 are then repeated in which the forward path movement and the return path movement of the carriage 22 are performed and also the reciprocating frequency counter N is incremented by the value 1. In a case where in Step S136, the reciprocating frequency counter N has reached the needed reciprocating frequency n, this routine is ended here.

$$Pc=(i-k)\times N \tag{2}$$

Here, the correspondence relation between a constituent element of this embodiment and a constituent element in the invention is clarified. The printing head 24 of this embodiment is equivalent to a "discharge head" in the invention, the carriage 22 is equivalent to a "carriage" in the invention, the carriage belt 32, the carriage motor 34, or the like is equivalent to a "driving section" in the invention, and the controller 60 which executes the ink agitation processing routine of FIG. 3 is equivalent to an "agitation control section" in the invention.

According to the ink jet printer 20 of this embodiment described above, in a case where agitation of ink in the ink cartridge 26 is needed, by setting the distance i at the time of the forward path movement when reciprocating the carriage 22 on which the ink cartridge 26 is mounted, to be longer than the distance k at the time of the return path movement, the reciprocating range of the carriage 22 is shifted in a direction away from the start position by a distance (i−k) per single reciprocation, so that it is possible to effectively disperse a load which acts on the carriage guide 28 or the carriage belt 32 in association with the reciprocation of the carriage 22. As a result, it is possible to prevent trouble such as breakage due to a load which is concentrated on the specific place of the carriage guide 28 or the carriage belt 32.

Figure 5:
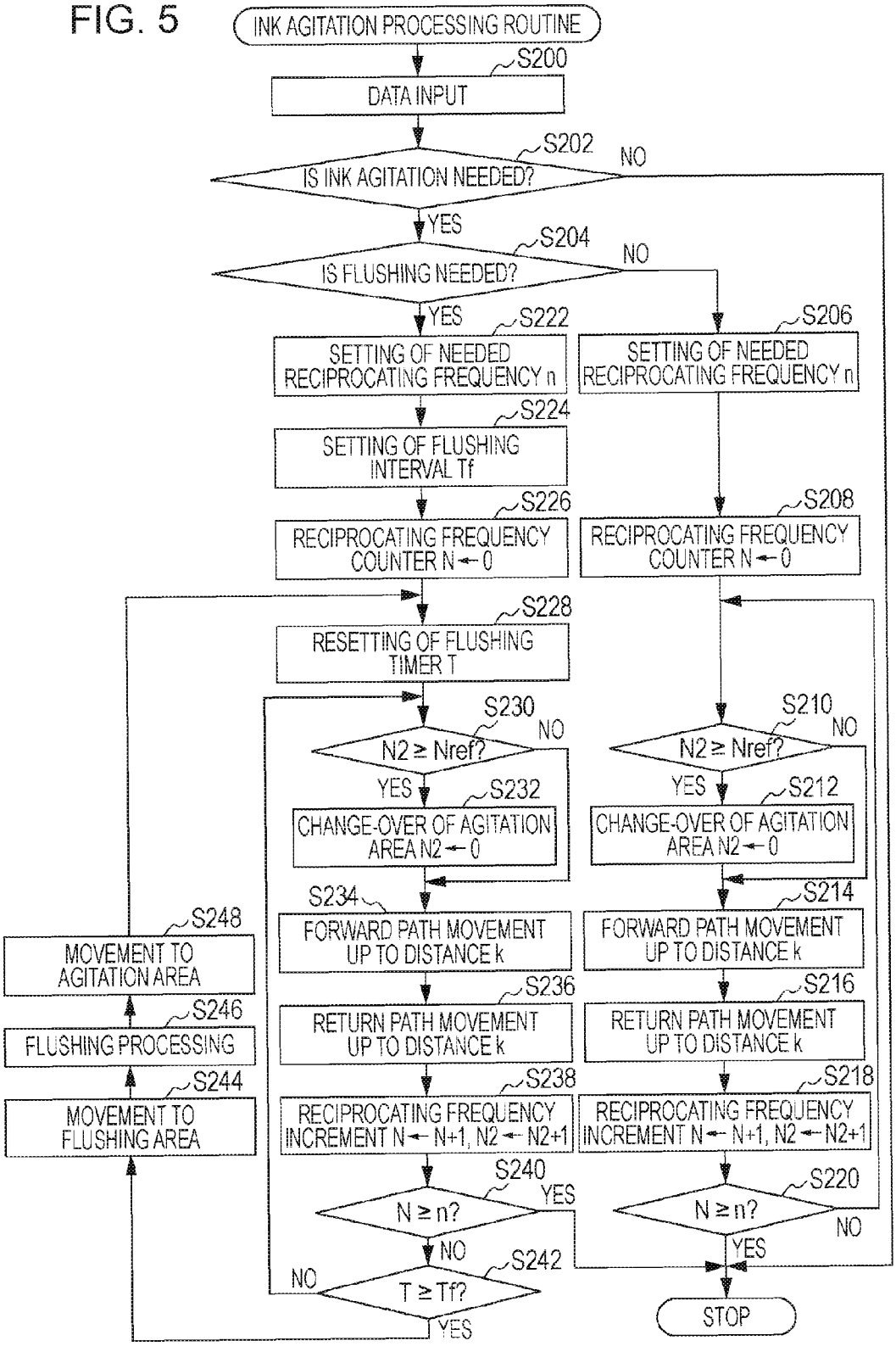
FIG. 5 is a flowchart illustrating an ink agitation processing routine of a second embodiment.
Figure 6A:
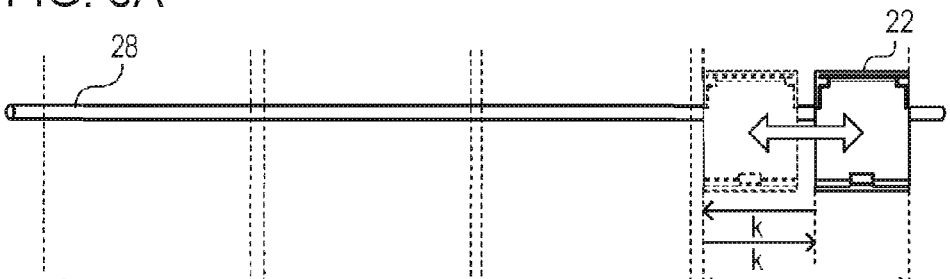
FIGS. 6A to 6D are explanatory diagrams illustrating the states of ink agitation.
Figure 6B:
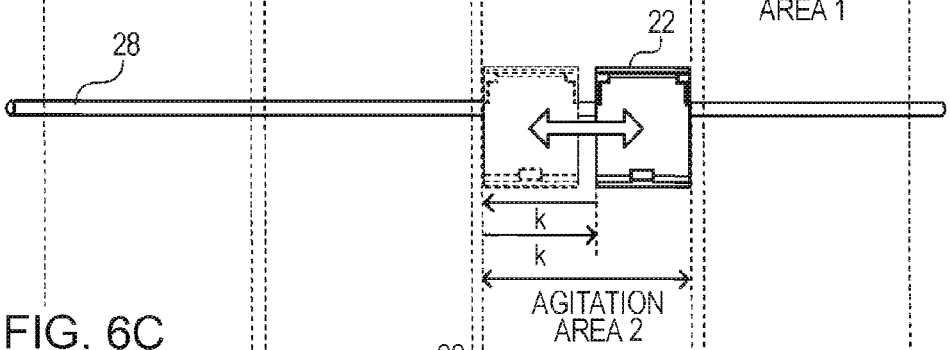
Figure 6C:
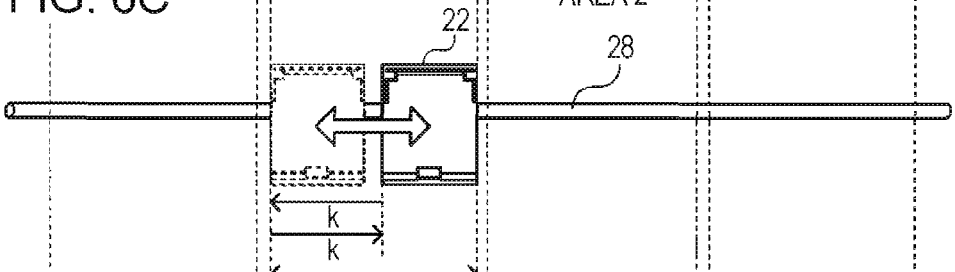
Figure 6D:
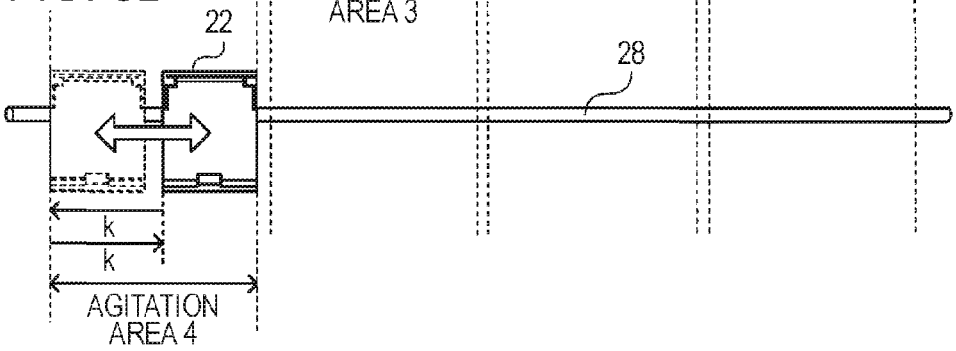

The ink jet printer 20 of a second embodiment is an example in which the reciprocating range (an agitation area) of the carriage 22 is provided at a plurality of places in advance such that all the agitation areas do not overlap each other, and the agitation area is changed over every time the carriage 22 reciprocates by the predetermined number of times. In the ink jet printer 20 of the second embodiment, in place of the ink agitation processing routine of FIG. 3, the ink agitation processing routine of FIG. 5 is executed. Hereinafter, the ink agitation processing routine of FIG. 5 will be described. In addition, since explanation with regard to the same process as that of the routine of FIG. 3 among the respective processes of the routine of FIG. 5 is overlapped, it is omitted as far as possible. In the ink agitation processing routine of FIG. 5, in a case where in Step S202, it is determined that ink agitation is needed and in Step S204, it is determined that flushing is not needed, the needed reciprocating frequency n is set (Step S206), similarly to Step S106 of FIG. 3, and after the reciprocating frequency counter N is initialized to the value 0 (Step S208), it is determined whether or not a second reciprocating frequency counter N2 is equal to or more than a predetermined number of times Nref (for example, 50 times, 70 times, or the like) (Step S210), and in a case where the second reciprocating frequency counter N2 is less than the predetermined number of times Nref, the forward path movement and the return path movement of the carriage 22 are performed with the movement distances k in the forward path and the return path set to be the same within the present agitation area (Steps S214 and S216). Then, the reciprocating frequency counters N and N2 are incremented by the value 1 (Step S218) and it is determined whether or not the reciprocating frequency counter N has reached the needed reciprocating frequency n (Step S220). In a case where the reciprocating frequency counter N has not reached the needed reciprocating frequency n, the routine returns to Step S210 and it is determined whether or not the second reciprocating frequency counter N2 is equal to or more than the predetermined number of times Nref (Step S210), and in a case where the second reciprocating frequency counter N2 is equal to or more than the predetermined number of times Nref, after the agitation area is changed over into the next area and also the second reciprocating frequency counter N2 is initialized to the value 0 (Step S212), the processes of Steps S214 to S218 are repeated in which the forward path movement and the return path movement of the carriage 22 are performed and also the reciprocating frequency counters N and N2 are incremented by the value 1. In FIGS. 6A to 6D, the states of ink agitation by movement of the carriage 22 are shown. Agitation of ink is performed by repeating a reciprocating operation of the carriage 22 in the range (distance k) of an agitation area and sequentially changing over agitation areas 1 to 4 every time the number of times of reciprocation (the second reciprocating frequency counter N2) reaches the predetermined number of times Nref, as shown in the drawing. In this embodiment, the four agitation areas 1 to 4 are determined such that all the respective ranges do not overlap each other. Therefore, it is possible to disperse a load which acts on the carriage guide 28 or the carriage belt 32 in association with the reciprocation of the carriage 22. Of course, the number of agitation areas is not limited to 4, and provided that it is within the range of the movable distance j of the carriage 22, any numbers are acceptable.

On the other hand, in a case where in Step S202, it is determined that agitation of ink is needed and in Step S204, it is determined that flushing is needed, the needed reciprocating frequency n is set (Step S222), similarly to Step S120 of FIG. 3, and also the flushing interval Tf is set (Step S224), similarly to Step S124. Then, the reciprocating frequency counter N is initialized to the value 0 (Step S226), and after the flushing timer T is reset (Step S228), it is determined whether or not the second reciprocating frequency counter N2 is equal to or more than the predetermined number of times Nref (Step S230), and in a case where the second reciprocating frequency counter N2 is less than the predetermined number of times Nref, the forward path movement and the return path movement of the carriage 22 are performed in the present agitation area (Steps S234 and S236), and in a case where the second reciprocating frequency counter N2 is equal to or more than the predetermined number of times Nref, after the agitation area is changed over and also the second reciprocating frequency counter N2 is initialized to the value 0 (Step S232), the forward path movement and the return path movement of the carriage 22 are performed (Steps S234 and S236). If the carriage 22 reciprocates once, the reciprocating frequency counters N and N2 are incremented by the value 1 (Step S238) and it is determined whether or not the reciprocating frequency counter N has reached the needed reciprocating frequency n (Step S240), and whether or not the flushing timer T has reached the flushing interval Tf (Step S242). In a case where the reciprocating frequency counter N has not reached the needed reciprocating frequency n and the flushing timer T has not reached the flushing interval Tf, the routine returns to Step S230 and the processes of Steps S230 to S238 are then repeated. On the other hand, in a case where although the reciprocating frequency counter N has not reached the needed reciprocating frequency n, the flushing timer T has reached the flushing interval Tf, the driving of the carriage motor 34 is controlled such that the carriage 22 moves to the flushing area 48 (Step S244), the flushing processing is executed (Step S246), the carriage is moved to the present agitation area after the flushing processing (Step S248), the routine returns to Step S230, and the processes of Steps 230 to S238 are then repeated. In a case where in Step 240, the reciprocating frequency counter N has reached the needed reciprocating frequency n, this routine is ended here.

In the second embodiment, a configuration is made such that the agitation area is changed over every time the carriage 22 reciprocates by the predetermined number of times. However, a configuration is also acceptable in which the agitation area is changed over every time the routine is executed (every time agitation of ink is started).

Figure 7:
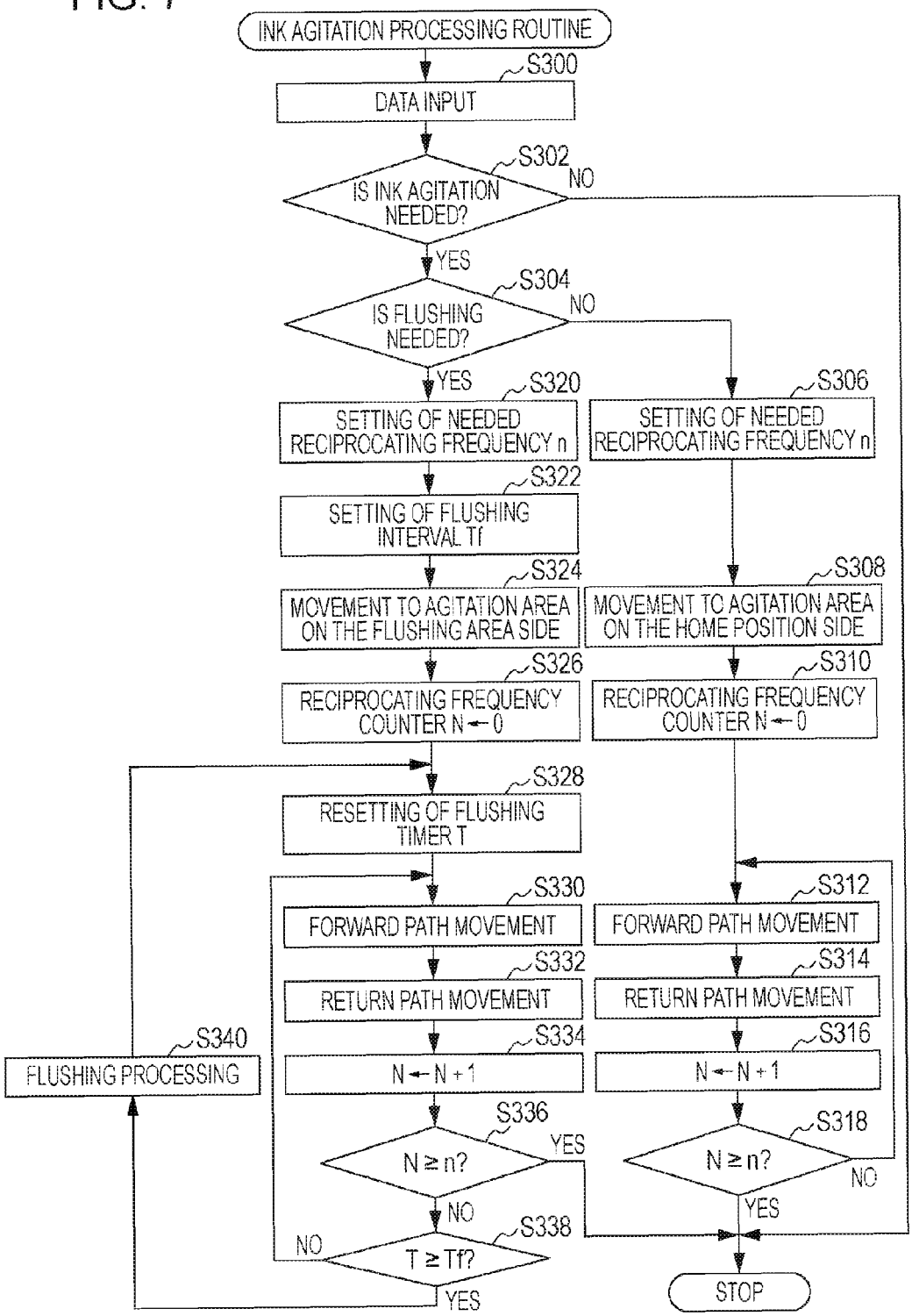
FIG. 7 is a flowchart illustrating an ink agitation processing routine of a third embodiment.

The ink jet printer 20 of a third embodiment of the invention is an example in which two agitation areas are respectively provided at the home position side and the flushing area 48 side on the opposite side to the home position and the two agitation areas are alternately changed over. In the ink jet printer 20 of the third embodiment, in place of the ink agitation processing routine of FIG. 3, the ink agitation processing routine of FIG. 7 is executed. Hereinafter, the ink agitation processing routine of FIG. 7 will be described. In addition, since explanation with regard to the same process as that of the routine of FIG. 3 among the respective processes of the routine of FIG. 7 is overlapped, it is omitted as far as possible. In the ink agitation processing routine of FIG. 7, in a case where in Step S302, it is determined that ink agitation is needed and in Step S304, it is determined that flushing is not needed, the needed reciprocating frequency n is set (Step S306), similarly to Step S106 of FIG. 3, and the driving of the carriage motor 34 is controlled such that the carriage 22 moves to the agitation area on the home position side (Step S308), and the reciprocating frequency counter N is initialized to the value 0 (Step S310). Then, the processes in which the forward path movement and the return path movement of the carriage 22 are performed and also the reciprocating frequency counter N is incremented by the value 1 are repeated (Steps S312 to S316), and when the reciprocating frequency counter N has reached the needed reciprocating frequency n (Step S318), this routine is ended here.

On the other hand, in a case where in Step S302, it is determined that agitation of ink is needed and in Step S304, it is determined that flushing is needed, the needed reciprocating frequency n is set (Step S320), similarly to Step S120 of FIG. 3, and also the flushing interval Tf is set (Step S322), similarly to Step S124, and the driving of the carriage motor 34 is controlled such that the carriage 22 moves to the agitation area on the flushing area 48 side (Step S324). Then, the reciprocating frequency counter N is initialized to the value 0 (Step S326), the flushing timer T is reset (Step S328), and the forward path movement and the return path movement of the carriage 22 are performed (Steps S330 and S332). If the carriage 22 reciprocates once, the reciprocating frequency counter N is incremented by the value 1 (Step S334), and it is determined whether or not the reciprocating frequency counter N has reached the needed reciprocating frequency n (Step S336) and whether or not the flushing timer T has reached the flushing interval Tf (Step S338). In a case where the reciprocating frequency counter N has not reached the needed reciprocating frequency n and the flushing timer T has not reached the flushing interval Tf, the routine returns to Step S330 and the forward path movement and the return path movement of the carriage 22 are repeated, and in a case where although the reciprocating frequency counter N has not reached the needed reciprocating frequency n, the flushing timer T has reached the flushing interval Tf, since the present agitation area is the agitation area on the flushing area 48 side, the flushing processing is executed as it is (Step S340), and after the flushing processing, the routine returns to Step 330 and the forward path movement and the return path movement of the carriage 22 are repeated. In a case where in Step S336, the reciprocating frequency counter N has reached the needed reciprocating frequency n, this routine is ended here.

Figure 8A:
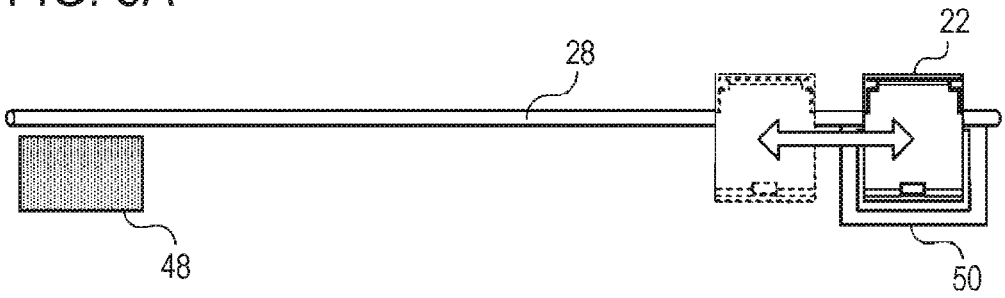
FIGS. 8A and 8B are explanatory diagrams illustrating the states of ink agitation.
Figure 8B:
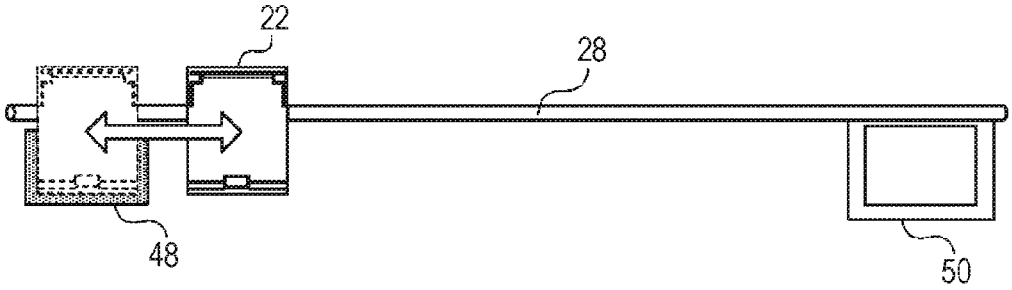
Figure 9A:
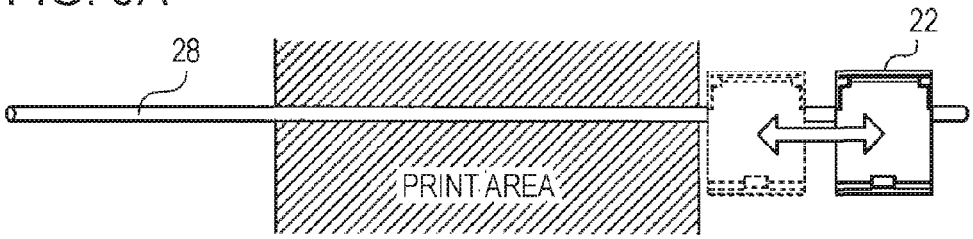
FIGS. 9A and 9B are explanatory diagrams illustrating the states of ink agitation.
Figure 9B:
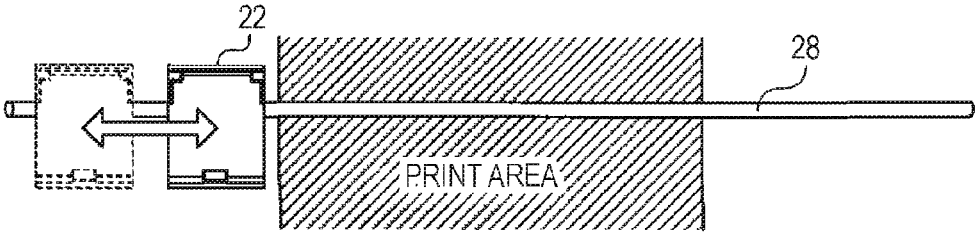

In FIGS. 8A and 8B, the states of agitation of ink according to the reciprocation of the carriage 22 are shown. Agitation of ink is performed by reciprocating the carriage 22 within the agitation area on the home position side in a case where the flushing processing is not needed, and reciprocating the carriage 22 within the agitation area on the flushing area 48 side in a case where the flushing processing is needed, as shown in the drawing. Further, the agitation area on the home position side and the agitation area on the flushing area 48 side are determined to be within a range avoiding paper of a given size, for example, a range avoiding a print area of postcard-sized paper in a printer capable of performing printing on paper of maximum A4-size, as shown in FIGS. 9A and 9B. Accordingly, because a load which acts on the carriage guide 28 or the carriage belt 32 when the carriage 22 reciprocates in print processing is also taken into account, it is possible to more effectively disperse the load.

In the embodiments described above, the invention has been applied to the ink jet printer 20 of a so-called on-carriage system in which the ink cartridge 26 is mounted on the carriage 22. However, the invention may also be applied to an ink jet printer of a so-called off-carriage system in which an ink cartridge is fixed to the frame 58 and the ink cartridge and the printing head 24 are connected to each other by a tube, thereby supplying ink. Also in this case, agitation of the ink in the printing head or the ink in the tube (in a case where the carriage is provided with a sub-tank separately from the ink cartridge, the ink in the sub-tank) is possible.

In the embodiments described above, as the printing head 24, the system of pressurizing ink by deforming a piezoelectric element by applying voltage to the piezoelectric element has been adopted. However, the system of pressurizing ink by air bubbles generated by heating ink by applying voltage to a heat-generating resistor body (for example, a heater or the like) may also be adopted.

In the embodiments described above, the image forming apparatus according to the invention has been described being applied to the ink jet printer 20. However, it may also be applied to a multifunctional printer which includes a scanner in which read-out of a manuscript is possible, or a facsimile apparatus having a facsimile function.

In addition, the invention is not limited to the above-described embodiments and it goes without saying that various embodiments can be implemented as long as they are within the technical scope of the invention.

The entire disclosure of Japanese Patent Application No. 2010-191244, filed Aug. 27, 2010 is expressly incorporated by reference herein.

What is claimed is:

1. An image forming apparatus that forms an image on a medium by discharging liquid from a discharge head, the apparatus comprising:

a carriage on which the discharge head is mounted;

a driving section which reciprocates the carriage; and an agitation control section which controls, in a case where agitation of the liquid is required, the driving section such that operation areas of a plurality of places set within a movable range of the carriage are changed over and the carriage then reciprocates within the operation areas;

wherein the operation areas of a plurality of places are set such that reverse positions when reciprocating the carriage do not overlap each other.

2. The image forming apparatus according to claim 1, wherein the agitation control section controls the driving section such that a moving distance at the time of forward movement as a single reciprocating operation of the carriage becomes longer than a moving distance at the time of return movement.

3. The image forming apparatus according to claim 1, wherein the agitation control section controls the driving section so as to gradually change the operation area while the carriage reciprocates.

4. The image forming apparatus according to claim 1, wherein the agitation control section reciprocates the carriage in order to agitate the liquid, immediately after power-on of the image forming apparatus.

5. The image forming apparatus according to claim 1, wherein the agitation control section reciprocates the carriage in order to agitate the liquid, after a predetermined time has elapsed from power-on of the image forming apparatus.

6. The image forming apparatus according to claim 1, wherein the agitation control section reciprocates the carriage in order to agitate the liquid, after a predetermined time has elapsed from a previous agitation operation of the liquid.

7. The image forming apparatus according to claim 1, further comprising:

an ink cartridge with the liquid stored therein, wherein the agitation control section reciprocates the carriage in order to agitate the liquid, when the ink cartridge has been replaced.

8. An image forming apparatus that forms an image on a medium by discharging liquid from a discharge head, the apparatus comprising:

a carriage on which the discharge head is mounted;

a driving section which reciprocates the carriage; and an agitation control section which controls, in a case where agitation of the liquid is required, the driving section such that operation areas of a plurality of places set within a movable range of the carriage are changed over and the carriage then reciprocates within the operation areas;

wherein the operation areas of a plurality of places are set such that the reciprocating ranges of the carriage do not overlap each other.

9. The image forming apparatus according to claim 8, wherein the operation areas of a plurality of places are set in ranges different from a range in which liquid is discharged onto a medium of a given size, within the movable range of the carriage.

10. The image forming apparatus according to claim 8, wherein the agitation control section reciprocates the carriage in order to agitate the liquid, immediately after power-on of the image forming apparatus.

11. The image forming apparatus according to claim 8, wherein the agitation control section reciprocates the carriage in order to agitate the liquid, after a predetermined time has elapsed from power-on of the image forming apparatus.

12. The image forming apparatus according to claim 8, wherein the agitation control section reciprocates the carriage in order to agitate the liquid, after a predetermined time has elapsed from a previous agitation operation of the liquid.

13. The image forming apparatus according to claim 8, further comprising:

an ink cartridge with the liquid stored therein, wherein the agitation control section reciprocates the carriage in order to agitate the liquid, when the ink cartridge has been replaced.

14. An image forming apparatus that forms an image on a medium by discharging liquid from a discharge head, the apparatus comprising:

a carriage on which the discharge head is mounted;

a driving section which reciprocates the carriage; and an agitation control section which controls, in a case where agitation of the liquid is required, the driving section such that operation areas of a plurality of places set within a movable range of the carriage are changed over and the carriage then reciprocates within the operation areas;

wherein s the operation areas of a plurality of places, a first operation area and a second operation area are respectively set on one end side and the other end side of the movable range of the carriage, the second operation area is an area which includes a flushing area that receives liquid discharged from the discharge head at the time of a flushing operation, and the agitation control section selects the first operation area in the case of reciprocating the carriage without a flushing operation of the discharge head, and selects the second operation area in the case of reciprocating the carriage with the flushing operation of the discharge head.

15. The image forming apparatus according to claim 14, wherein the agitation control section reciprocates the carriage in order to agitate the liquid, immediately after power-on of the image forming apparatus.

16. The image forming apparatus according to claim 14, wherein the agitation control section reciprocates the carriage in order to agitate the liquid, after a predetermined time has elapsed from power-on of the image forming apparatus.

17. The image forming apparatus according to claim 14, wherein the agitation control section reciprocates the carriage in order to agitate the liquid, after a predetermined time has elapsed from a previous agitation operation of the liquid.

18. The image forming apparatus according to claim 14, further comprising:

an ink cartridge with the liquid stored therein, wherein the agitation control section reciprocates the carriage in order to agitate the liquid, when the ink cartridge has been replaced.

* * * * *